United States Patent [19]

Hutt

[11] Patent Number: 4,739,964

[45] Date of Patent: Apr. 26, 1988

[54] DIFFUSER VALVE

[76] Inventor: James J. Hutt, 15 Moray Place, Whiritoa, New Zealand

[21] Appl. No.: 933,754

[22] Filed: Nov. 21, 1986

Related U.S. Application Data

[63] Continuation of Ser. No. 726,078, Apr. 22, 1985, abandoned.

[30] Foreign Application Priority Data

Apr. 30, 1984 [NZ] New Zealand ..... 207993

[51] Int. Cl.[4] ..... F16K 31/383

[52] U.S. Cl. ..... 251/63.6; 251/147; 251/154; 222/195; 366/101

[58] Field of Search ..... 239/143, 654; 406/92, 406/136, 137; 366/101, 106; 222/195; 251/63.5, 63.6, 144, 147, 154–156, 186, 356; 137/1; 52/192, 195–197

[56] References Cited

U.S. PATENT DOCUMENTS 3,949,963 4/1976 Aoki ..... 251/63.6
4,261,389 4/1981 Hager et al. ..... 251/144

FOREIGN PATENT DOCUMENTS 569411 4/1924 France ..... 251/63.6
1156173 5/1958 France ..... 251/144

*Primary Examiner*—Samuel Scott
*Assistant Examiner*—Noah Kamen
*Attorney, Agent, or Firm*—Abelman Frayne Rezac & Schwab

[57] ABSTRACT

A controllable valve adapted to be fixed in the wall of a storage hopper containing particulate materials and operable to dispense an air blast into the interiors of the hopper to loosen the materials in the region of the valve.

2 Claims, 3 Drawing Sheets

DIFFUSER VALVE

This is a continuation of application Ser. No. 726,078 filed on Apr. 22, 1985, now abandoned.

BACKGROUND OF THE INVENTION

This invention relates to valves and has particular relevance to diffuser valves used to desseminate material within a hopper or the like, although as will be appreciated from the ensuing description the present invention has wide application and may be put to a number of uses.

When particulate materials such as powders are stored in a hopper problems often arise because the powder tends to "bridge" or, even in some cases pack solid, and this may be the case whether the material inside the hopper is moist or dry. When material within a hopper does bridge or pack solid if there are no mechanical facilities for correcting the condition it is necessary for the materials to be loosened manually so that predetermined flows from the hopper can be maintained.

To overcome the problem of bridging or packing it is known to provide a plurality of nozzles which are provided in strategic positions on or within a hopper and to apply high pressure air via the nozzles to the material within the hopper in an endeavour to correct the problem. Other means for overcoming the problem have included dispersing air through members which protrude into the hopper interiors however neither of the solutions to the problem have proved to be totally effective or economic.

SUMMARY OF THE INVENTION

It is an object of the present invention to provide a controllable valve which may be effectively used in the aforesaid situations.

Further objects and advantages of the present invention will become apparent from the ensuing description.

According to the present invention therefor there is provided a controllable valve comprising a body, a valve member mounted within the body, said valve member comprising a stem mounted for reciprocation within the body and a valve head opening to a positioned at one end of the body, a fluid outlet positioned at said one end of the body and including a valve seat upon which a valve face of the valve head may rest, and means communicable with said fluid outlet by which the valve may be connected to a fluid under pressure, the construction and arrangement being such that, in use, with the valve mounted in the wall of a container and the valve outlet extending into the interiors of the container, when fluid under pressure is applied to the outlet the valve member opens to allow said fluid to be dispersed via the outlet between the valve seat and the valve face.

BRIEF DESCRIPTIONS OF THE DRAWINGS

Aspects of the present invention will now be described by way of example only with reference to the accompanying drawings in which:

FIG. 1: is a diagrammatic long section of a controllable valve in accordance with one possible embodiment of the present invention, and FIG. 2: is a partial perspective view and section of the controllable valve of FIG. 1, and FIG. 3: is a side view of the controllable valve of FIG. 1.

DESCRIPTION OF THE PREFERRED EMBODIMENT

Figure 1:
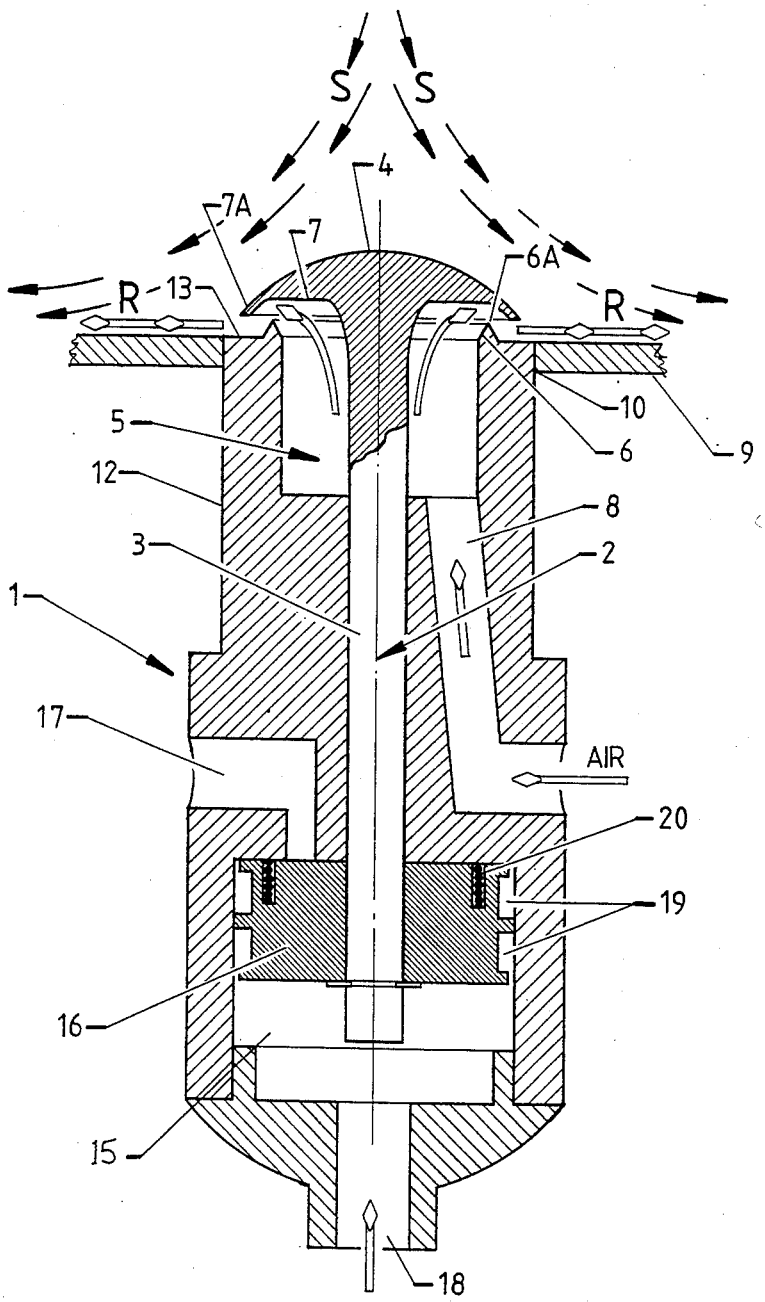

According to the present invention a controllable valve can comprise a body generally indicated by arrow 1, a valve member generally indicated by arrow 2, mounted within a body, said valve member comprising a stem 3 mounted for reciprocation in the body 1 and a valve head 4 opening to a positioned at one end of the body. The end of the diffuser valve is provided with a fluid outlet generally indicated by arrow 5 which includes a valve seat 6 upon which a valve face 7 of the valve head 4 can rest, and means such as passage 8 communicable with the fluid outlet 5 by which the valve may be connected to a fluid under pressure. The valve is constructed and arranged such that in use, with the valve mounted in the wall 9 of a container and the valve outlet extending into the interiors of an object (not shown). When fluid under pressure is applied to the fluid outlet 5 the valve member 2 opens to allow fluid to be dispersed via the outlet between the valve seat 6 and the valve face 7.

Figure 2:
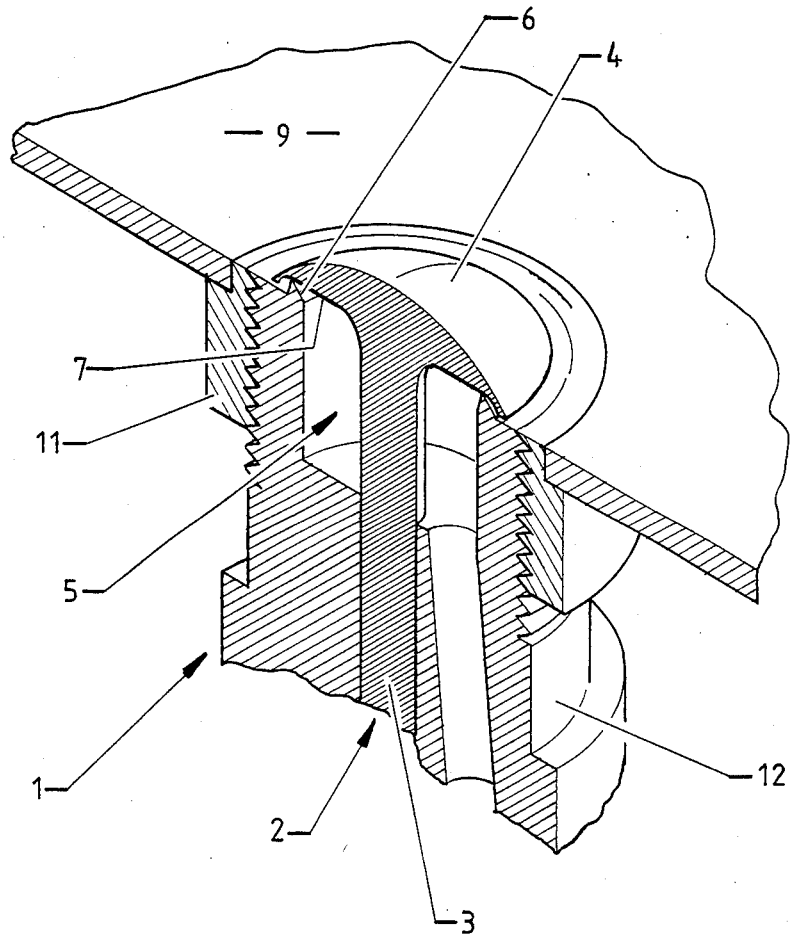
Figure 3:
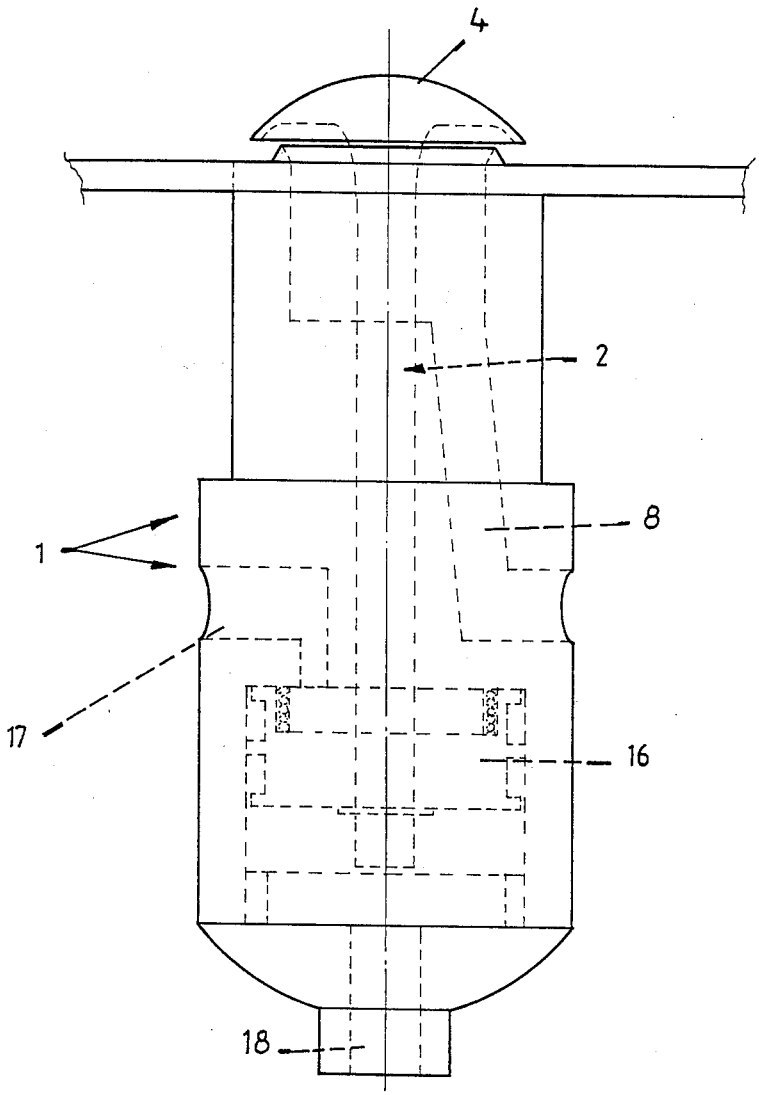

In the drawings the valve is shown in an open position in FIGS. 1 and 3, and a closed position in FIG. 2.

Where the valve is used as a diffuser valve to assist the passage of particulate materials from a hopper (not shown) a number of the valves can be positioned strategically about the walls of the hopper with the valve being mounted over apertures 10 therein and the valve body being fixed to a socket 11 (FIG. 2 only) which is fixed over the apertures 10. A convenient way to unite the socket and the body is to have an internal thread on the socket 11 and a matching external thread on the upper extremities 12 of the body 1 as indicated. When the valve member is fitted the valve is positioned such that extreme edges 13 of the body 1 are flush with the interiors of the wall 9 if the hopper and the outer extremities of the valve face extend above the inner surfaces of the wall 9 of the hopper.

When a fluid such as compressed air is applied to the fluid outlet 5 of the valve member 2 lifts and the valve face 7 is separated from the valve seat 6 which as indicated presents a knife-edge 6A to the valve face. The valve face 7 is provided with an arcuate surface, the outer extremities 7A of which overhang the valve seat 6 such that fluid escaping from the outlet is directed substantially at right angles to the lengthwise axis of the valve member and across the surfaces of the interiors of the hopper 9 substantially as indicated by the path arrows R in FIG. 1 and particulate materials in the hopper and immediately surrounding the valve head 4 would tend to flow in the same direction as the path arrows S creating an inverted vortex in the region above the arcuate surface of the valve head 4. When the hopper is empty the valve may be closed although as will be appreciated the valve may be used in an open position as required.

It will be appreciated by those skilled in the art to which the present invention relates, that the valve member 2 may be normally biased in a closed position by having a biasing spring 20 acting on the valve stem which would be overcome when fluid under pressure enters the outlet 5.

The fluid outlet 5 is a pressure equalising chamber which will ensure that equal pressure is provided about the periphery of the valve face to lift the valve.

In some applications where the diffuser valve is used, air or liquids may be available at different pressures. In such a case and in accordance with the embodiment illustrated the valve body can incorporate a fluid chamber 15 at the end opposite to the fluid outlet and into which the valve stem 3 extends. The valve stem 3 can mount a piston 16 and an inlet means 17, 18 can be provided communicable with opposite sides of the piston such that when a fluid such as air at different pressures is applied to opposite sides of the piston this will cause the valve member to reciprocate to and from open and closed positions. The piston 16 can be provided with peripheral grooves 19 into which rubber O-ring seals or the like (not shown) can be fitted.

For the valve illustrated air at high pressure can be provided via inlet 8 and inlet 18 whilst air at a lower pressure (or a vacuum) can be applied at inlet 17. The valve will then move to an open position.

Preferably the valve can be moulded or fabricated in stainless steel, such being an excepted material for food industries where contract between machine and product is made during manufacturing processes. The valve could however be mounted or fabricated in other materials such as plastics.

In some uses the valve can be used to disperse a liquid into an object for the purpose of cleaning or fire fitting.

The knife edge 6A of the valve seat 6 is designed to eliminate the possibility of particulate materials clogging up the valve outlet.

The valve described can be conveniently fitted to existing installations by mounting the socket 11 in position as indicated and then fixing the valve and its connections.

Where the piston 16 is used to affect opening or closing of the valve then its cross-sectional area on the closing side can be made to be greater than the exposed cross-sectional area of the valve head so that a common pressure source can be applied to those areas.

Aspects of the present invention have been described by way of example only and it is to be appreciated that modifications and additions thereto may be made without departing from the scope thereof, as defined in the appended claims.

I claim:

1. A controllable anti-compaction device for hopper stored particulate materials, comprising:

a valve having a valve body secured within a wall of a hopper;

a substantially planar ring-shaped valve seat of said valve body positioned substantially in co-planar relationship with an adjacent inner-wall surface of said hopper;

a valve member having a valve head cooperable with said valve seat, and positioned within the interior of said hopper, said valve member and valve head being moveable axially between a first position in which a peripheral skirt of said valve head is in seating engagement with said valve seat and an outer peripheral edge of said valve head is positioned closely adjacent to an end wall of said valve body; and a second position in which said valve head is spaced from said valve seat and said peripheral edge is spaced from said end wall to define, in conjunction with said end wall, a ring-shaped ejection orifice for compressed air operative to direct compressed air at high velocity in a substantially laminar flow radially of said valve member and in substantially parallel relationship with said inner wall of said hopper; and fluid operated means for controlling movement of said valve head between said first and said second positions;

said fluid operated means being operative to progressively move said valve head towards said first position against forces exerted on said valve head by said compressed air, in order to progressively increase the velocity of said compressed air exiting said valve as said valve head moves toward said second position, and, to purge and scavange particulate matter from beneath said valve head.

2. The device of claim 1, in which said valve head has a convex outer surface exposed to the interior of said hopper, said convex surface representing a minor segment of a sphere of large diameter, in order to minimize compaction of particulate material in the vicinity of said valve head at the time said valve is in its closed first position, said peripheral outer edge of said skirt extending axially of said valve member and towards said end wall of said valve body for it to define a constricted outlet orifice.

* * * * *